US005692968A

United States Patent [19]

Shine

[11] Patent Number: 5,692,968

[45] Date of Patent: Dec. 2, 1997

[54] GOLF PUTTER WITH VIBRATION DAMPENING AND GOLF BALL PICKUP AND RELEASE

[76] Inventor: Randall S. Shine, 10231 Von Kleiben Rd., Sonora, Calif. 95370

[21] Appl. No.: 664,866

[22] Filed: Jun. 17, 1996

[51] Int. Cl.[6] ..... A63B 53/04; A63B 47/02

[52] U.S. Cl. ..... 473/286; 473/340; 473/332; 473/350; 294/19.2

[58] Field of Search ..... 473/340, 282, 473/345, 286, 350, 332, 339; 294/19.2

[56] References Cited

U.S. PATENT DOCUMENTS

| | | | |
|---|---|---|---|
| D. 217,483 | 5/1970 | Jackson | D21/218 |
| 2,448,644 | 12/1948 | Williams | 294/19.2 |
| 2,538,325 | 11/1951 | Pfeiffer | 294/19.2 |
| 3,374,027 | 3/1968 | Jacobs | 473/286 |
| 3,462,184 | 8/1969 | Russell | 294/19.2 |
| 3,520,569 | 7/1970 | Anderson | 294/19.2 |
| 4,180,288 | 12/1979 | Sievers | 294/19.2 |
| 4,248,430 | 2/1981 | Kepler | 473/286 |
| 4,313,604 | 2/1982 | Baxter | 473/132 |
| 4,313,632 | 2/1982 | King et al. | 294/19.2 |
| 4,580,784 | 4/1986 | Brill | 473/286 |
| 5,102,139 | 4/1992 | Greig | 473/286 |

OTHER PUBLICATIONS

It is believed that the prior art also includes a Merlin Industries putter that is capable of picking up a ball, but the details are not known. A photocopy of an ad is submitted. It is also believed that there is a McQuick Putter having a rubber O-ring and a push button ball release for retreiving and releasing a ball.

*Primary Examiner*—Sebastiano Passaniti
*Assistant Examiner*—Stephen L. Blau
*Attorney, Agent, or Firm*—Harris Zimmerman

[57] ABSTRACT

A golf club that enables a golfer to retrieve a ball from the ground as well as from a cup includes a club head having a front striking surface. A ball pickup structure includes a concave recess extending into a rear end surface of the body, the concave recess having a generally cylindrical conformation and an axis generally parallel to the striking surface. A pair of resilient fingers are secured to the rear end surface of the body and spaced apart to straddle the concave recess. The fingers include curved interior surfaces disposed in confronting relationship to the concave recess. The fingers and the concave recess together define a lower opening having a longitudinal (front-to-back) dimension slightly less than a golf ball diameter The lower opening may be placed superjacent to a golf ball and the head urged downwardly so that the ball moves relatively upwardly into the lower opening. The distal ends of the fingers flex outwardly to permit the ball to pass into the lower opening and move upwardly, the distal ends of the fingers asserting a gripping effect, whereby the user may retrieve and lift the ball. A thin lip extends rearwardly from the upper surface of the club head into the concave recess. The lip defines an upper opening that is narrower than the concave recess in the front-to-back dimension, and serves as a positional stop for the ball pickup structure. A ball lodged in the pickup position may be impinged against the ground, urging the ball relatively upwardly so that the lip and the distal ends of the fingers support the ball in freely releasable fashion.

20 Claims, 6 Drawing Sheets

GOLF PUTTER WITH VIBRATION DAMPENING AND GOLF BALL PICKUP AND RELEASE

BACKGROUND OF THE INVENTION

This invention relates to golf club design, and more particularly to a club design that includes a new ball pickup feature.

In the game of golf, a player puts the ball into play at the tee of each hole, and the ball is not handled by the player (assuming no strokes hit out of bounds or into hazards) until it is picked up from the cup on the green. Generally, the golfer must bend or kneel to reach the ball, which rests in the hole below ground level. There is a significant number of golfers who, due to lack of agility, age, fatigue, or other factors find it difficult to retrieve the ball from the ground or from the cup.

In recent years putters have been devised that include a feature for retrieving the ball from the ground without requiring bending effort of the golfer. This utilitarian feature generally comprises a rear surface portion opposed to the striking surface of the club head that enables the golfer to scoop a ball from the ground and flip it upwardly to be caught. Although this feature is a great convenience, it cannot be used with a ball that has fallen in the cup, due to the lack of lateral clearance required to scoop the ball. As a result, a golfer using a putter so equipped must first dislodge the ball from the cup by working the putter blade around inside the cup. This technique can be ineffective and frustrating, and may result in damage to the lip of the cup and the surrounding putting green turf.

Accordingly, the ball-retrieving features of prior art putters is inadequate and in need of improvement.

SUMMARY OF THE INVENTION

The present invention generally comprises a golf putter design that enables a golfer to retrieve a ball from the ground as well as from a cup. The invention also permits retaining the ball in the club head for engaging, lifting, carrying, and releasing and tossing the ball, as needed or desired by the golfer.

The golf putter design includes a club head comprised of a horizontally extending body having a front striking surface at one end. The club shaft is joined to the club head at an upper surface of the body. A ball pickup structure includes a concave recess extending into a rear end surface of the body, the concave recess having a generally cylindrical conformation and a radius of curvature that closely approximates the radius of a standard golf ball. The concave recess is a slot-like aperture extending from the upper to lower surfaces of the body, along an axis that extends upwardly generally parallel to the striking surface.

The ball pickup assembly further includes a pair of resilient fingers secured to the rear end surface of the body and spaced apart to straddle the concave recess. The distal ends of the fingers are disposed in confronting, closely spaced relationship. The fingers include curved interior surface portions disposed in confronting relationship to the concave recess, the interior surface portions also having radii of curvature closely approximating the radius of a standard golf ball. The upper surfaces of the fingers taper toward the lower surfaces from the rear end surface of the body to the distal ends of the fingers. The outer surfaces of the fingers blend with the outer side surface contours of the body to form smoothly and continuously curved side and rear body surfaces that have a diameter less than the diameter of a standard golf hole cup.

The fingers and the concave recess together define a lower opening having sufficient lateral width (side-to-side) to receive a golf ball, and a longitudinal (front-to-back) dimension slightly less than a golf ball diameter. By wielding the club from the handle end, the lower opening may be placed superjacent to a golf ball and the club head urged downwardly so that the ball is moved relatively upwardly into the lower opening. The curved ball surface urges the distal ends of the resilient fingers to flex outwardly, effecting sufficient clearance to permit the ball to pass into the lower opening and move upwardly along the axis of the concave recess. The distal ends of the fingers maintain a resilient, frictional contact with the ball and urge the ball surface into impingement with the curved sidewall of the concave recess and thereby asserting a gripping effect. Once the nominal equator of the ball is disposed above the fingers, the ball is retained within the recess and may be lifted with the club head, whereby the user may retrieve, carry and transport the ball.

The invention further includes a ball release feature operatively associated with the ball pickup feature. A thin lip is formed smoothly and continuously with the upper surface of the club head body, the lip extending rearwardly into the upper end of the concave recess. The lip is provided with a smoothly curved peripheral edge which defines an upper opening that is narrower than the concave recess in the front-to-back dimension.

The lip serves as a positional stop for the ball pickup feature described above. When the nominal equator of the golf ball is urged into the lower end of the concave recess, the ball translates upwardly until it impinges on the curved edge of the lip. In this pickup position the ball is gripped by the distal ends of the resilient fingers against the curved surface of the concave recess, as described above, and the ball is lodged in the ball pickup feature. Also, a small portion of the ball extends downwardly from the concave recess below the lower surface of the club head body.

The ball release feature involves moving the ball lodged in the pickup position to a release position in which the ball is supported by, but not secured to the club head. With a ball lodged in the first position, the club may be wielded by the handle to urge the protruding portion of the ball against the ground or floor surface. This is done most easily by placing the lower front edge of the club head and the protruding ball against the ground surface, and rocking the club head downwardly and rearwardly to increase the pressure on the protruding ball. The ball is thus urged relatively upwardly in the concave recess to the release position, in which a nominal equator of the ball is disposed above a plane extending through the lip and the distal ends of the fingers. The lip and the distal ends of the fingers support the ball, and the upper opening of the concave recess forms a receptacle that receives a lower portion of the ball and thus stabilizes the ball. The ball is not frictionally retained or otherwise gripped in any way, and may be removed by tilting the club head to cause the ball to roll out of the receptacle. Alternatively, the club head may be flipped upwardly to toss the ball out of the receptacle and be caught by the golfer.

The resilient fingers further comprise a mass of vibration absorbing and acoustic dampening material that is intimately secured to the rear surface of the club head. Vibration generated at the front striking surface by impact with a golf ball is conducted with little loss to the rear surface of the club head, where it is dampened and absorbed to a significant extent by the mass and conformation of the resilient fingers. As a result, the vibrational resonance through the club head and shaft are reduced, leading to a more accurate ball trajectory and better feel for the stroke by the player. Thus the ball pickup and release features of the invention synergistically improve the performance of the club.

DESCRIPTION OF THE PREFERRED EMBODIMENT

The present invention generally comprises a golf club construction that enables a golfer to retrieve a ball from the ground as well as from a cup. This function is carried out by a structure that does no interfere nor limit the use of the club to strike a golf ball. The invention also permits retaining the ball in the club head for engaging, lifting, carrying, and releasing and tossing the ball, as needed or desired by the golfer. Although the invention may be applied to a variety of clubs, including irons and woods, it will be described with reference to a golf putter.

Figure 2:
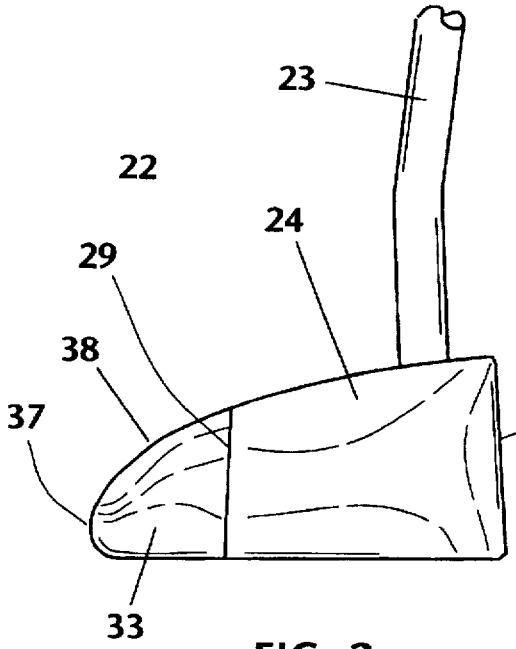
FIG. 2 is a side elevation of the golf club head shown in FIG. 1.
Figure 1:
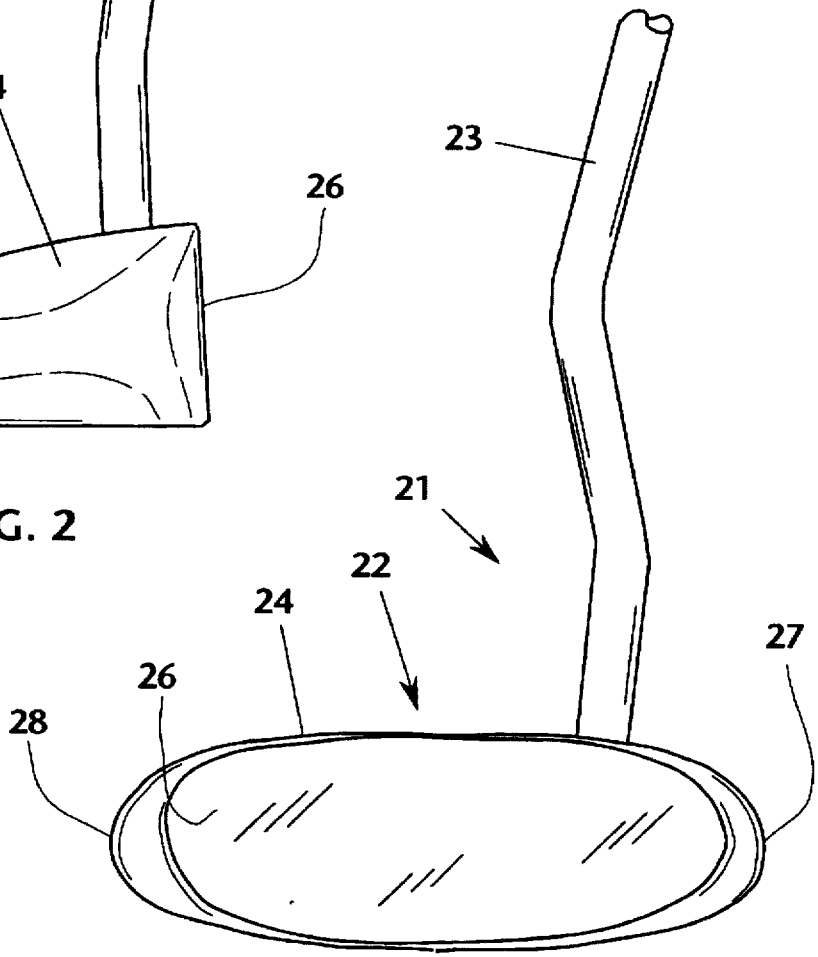
FIG. 1 is a front elevation of the golf club head incorporating the ball pickup and release of the present invention.
Figure 4:
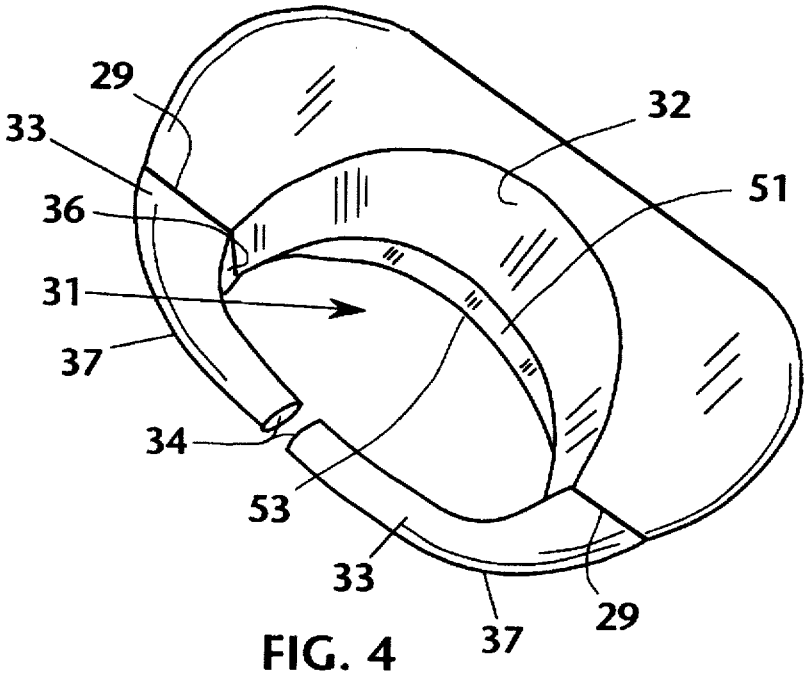
FIG. 4 is a perspective bottom view of the club head shown in FIGS. 1–3.
Figure 3:
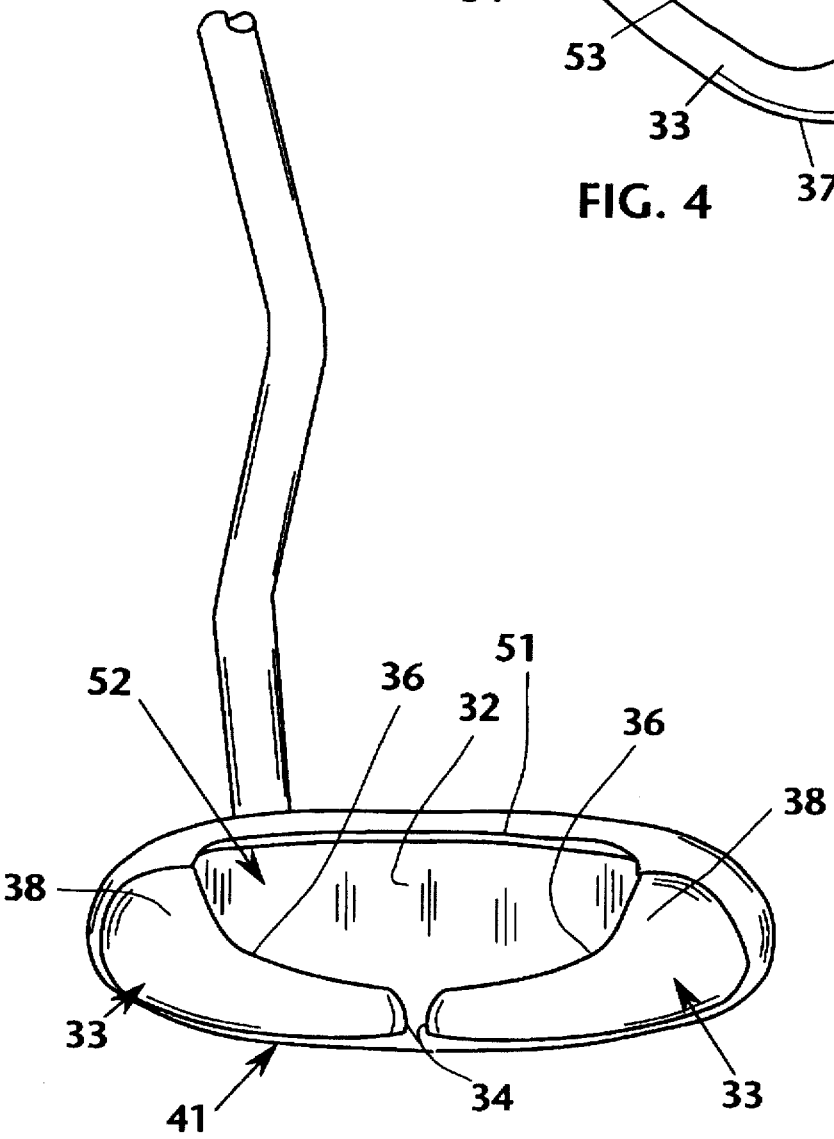
FIG. 3 is a rear elevation of the golf club head shown in FIGS. 1 and 2.
Figure 5:
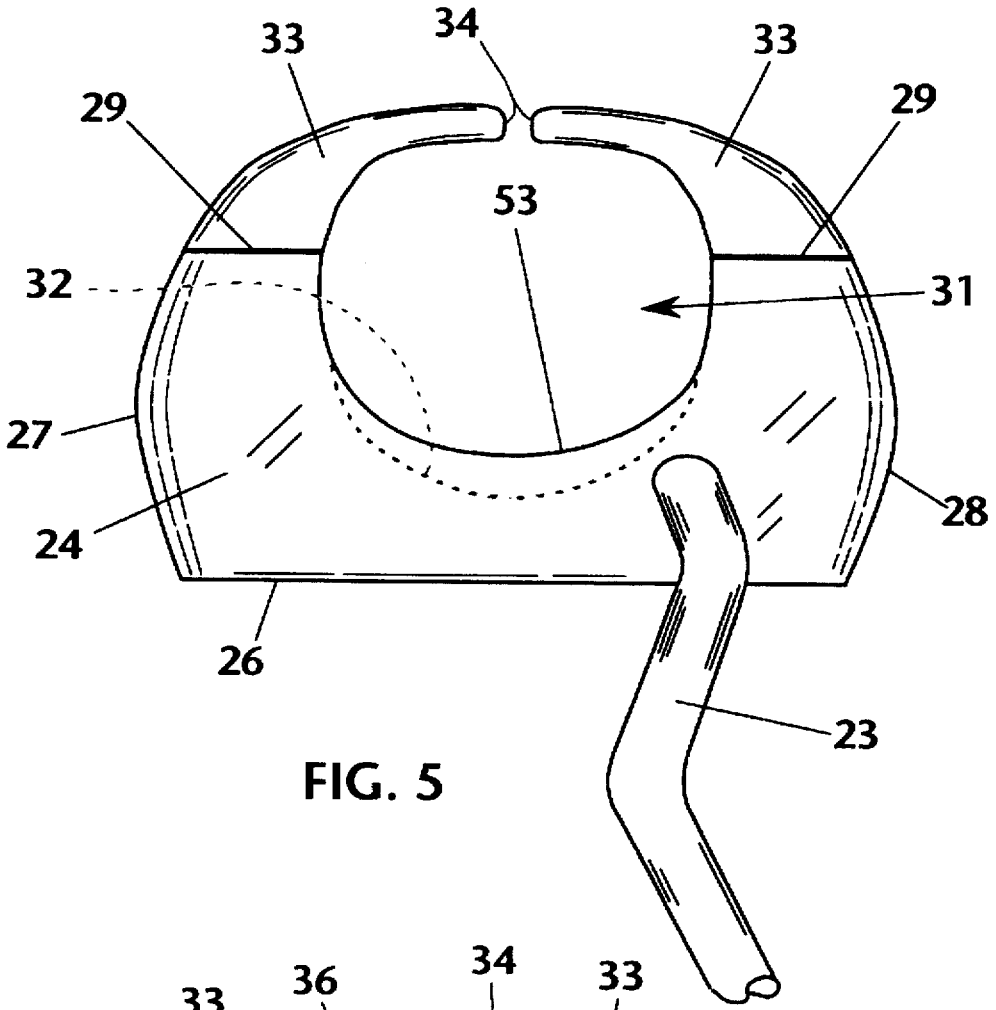
FIG. 5 is a top plan view of the club head shown in FIGS. 1–4.
Figure 6:
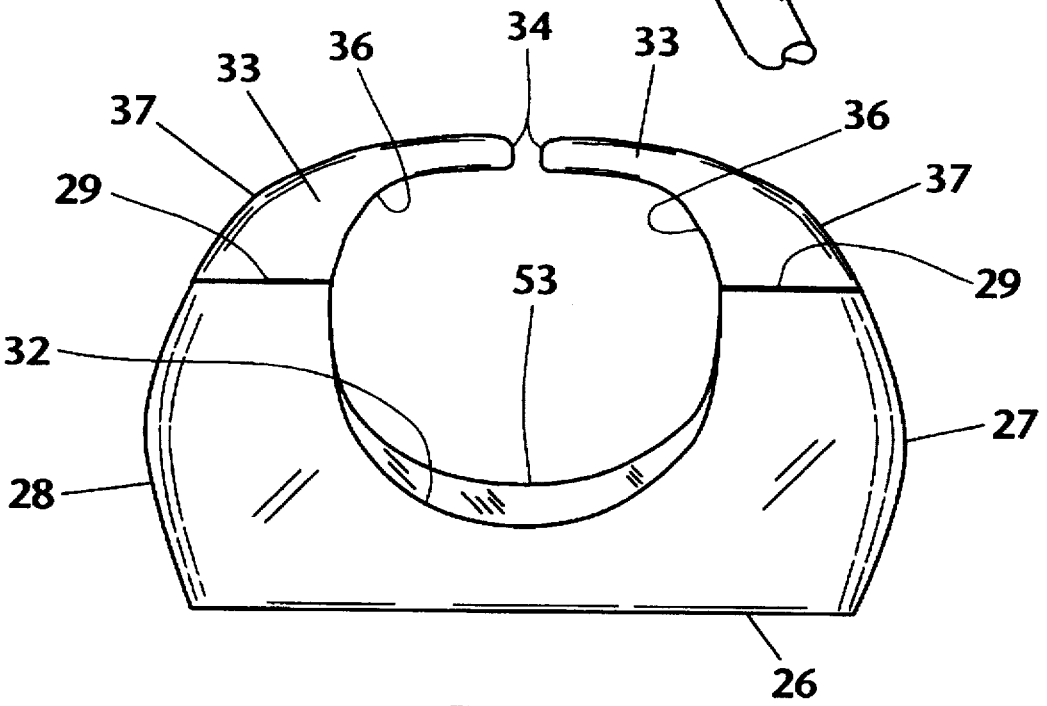
FIG. 6 is a bottom plan view of the club head shown in FIGS. 1–5.

With regard to the accompanying Figures, and FIGS. 1–6 in particular, a golf putter 21 includes a club head 22 and a club shaft 23 extending upwardly from the club head. The club head 22 includes a body 24 extending generally horizontally and having a planar striking surface 26 at the front end thereof. As shown in FIG. 1, the body 24 is generally ellipsoid in the lateral (side-to-side) aspect. The opposed side surfaces 27 and 28 (FIGS. 5 and 6) are curved, and the rear surface 29 of the body is planar and generally parallel to the striking surface 26. This body conformation facilitates implementation of the ball pickup and ball release features, but other club head body shapes and styles may be used without diverging from the teaching or spirit of the invention.

The ball pickup structure of the invention includes a concave recess 31 extending into the rear surface 29 of the body 24. The concave recess is a slotted aperture extending from the upper to lower surfaces of the body, along an axis that extends upwardly generally parallel to the striking surface. The recess 31 has a curved, generally cylindrical sidewall 32 extending along an axis of symmetry that is generally parallel to the plane of the striking surface 26. The radius of curvature of the sidewall 32 closely approximates the radius of a standard golf ball. The concave recess 31 extends from the bottom surface to the top surface of the body 24.

The ball pickup structure further includes a pair of resilient fingers 33 secured to the rear surface 29 of the body 24, the fingers disposed in spaced apart fashion to straddle the concave recess. The fingers 33 include distal ends 34 disposed in confronting, closely spaced relationship. The fingers include curved interior surfaces portions 36 that smoothly blend with the curvature of the sidewall 32 and are provided with similar radii of curvature. The outer surfaces 37 of the fingers blend with the contours of the side surfaces 27 and 28 of the body to form an assembly having smoothly and continuously curved side and rear body surfaces that have a diameter less than the diameter of a standard golf hole cup. The upper surfaces 38 of the fingers taper toward the lower surfaces from the rear surface 29 of the body to the distal ends 34 of the fingers.

The resilient fingers 33 may be formed of an elastic, deformable substance such as rubber, polymer plastic, or the like. Alternatively, the entire body and fingers may be cast or otherwise formed in integrally of a material that permits elastic flexure of the distal ends 34 of the fingers.

The resilient fingers 33 and the rigid sidewall 32 of the concave recess together define a lower opening 41 having sufficient lateral width (side-to-side) to receive a golf ball, and a longitudinal (front-to-back) dimension slightly less than a golf ball diameter. Thus sufficient clearance for a ball translating through the opening 41 can be obtained only by outward flexure of the distal ends 34 of the fingers 33.

Figure 8:
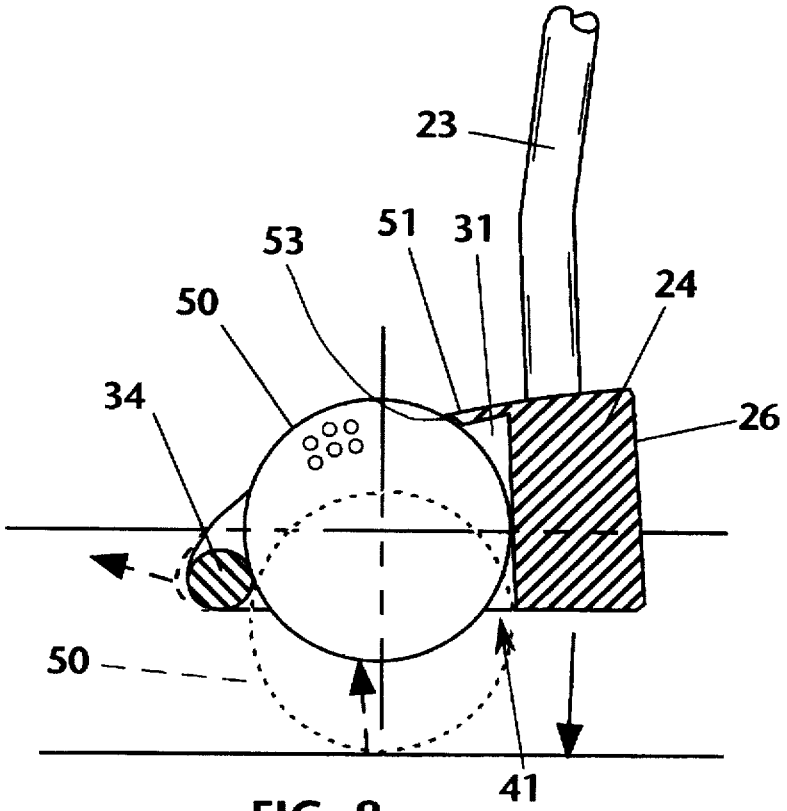
FIG. 8 is a cross-sectional side elevation of the golf club head, taken along line 8—8 of FIG. 7.

To employ the ball pickup feature of the golf club, the club is wielded from the handle end and maneuvered to place the club head 22 over a golf ball 50 on the ground, with the lower opening 41 directly superjacent to the ball, as shown in phantom line in FIG. 8. The club head 22 is urged downwardly so that the ball 50 is moved relatively upwardly into the lower opening 41. The curved surface of the upper extent of the ball 50 impinges on the distal ends 34 of the fingers 33 and urges the distal ends 34 to flex outwardly, creating sufficient clearance to permit the ball 50 to pass into the lower opening 41 and translate upwardly along the axis of the concave recess 31.

Figure 7:
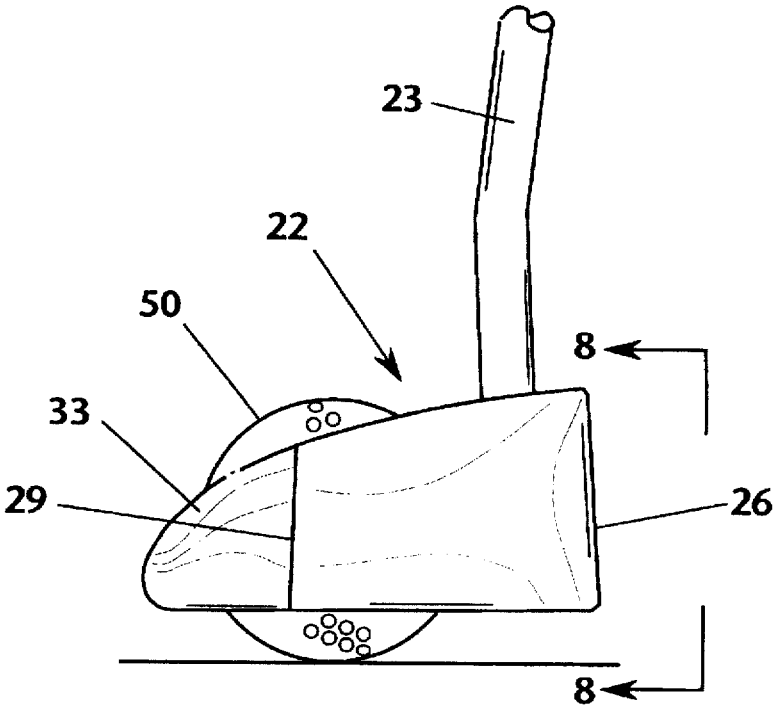
FIG. 7 is a side elevation of the golf club head as in FIG. 1, with a golf ball engaged in the ball pickup.

The distal ends 34 of the fingers exert a resilient, frictional contact with the ball 50 and urge the surface of the ball into impingement with the curved sidewall 32, thereby asserting a gripping effect and securing the ball 50. Once any nominal equator of the ball is disposed above the finger ends 34, the ball 50 is retained within the recess 31, as shown in FIGS. 7 and 8, and may be lifted with the club head, whereby the user may retrieve, carry and transport the ball. Thus a golf ball 50 resting on the ground may be gripped and lifted from the ground, without recourse to bending or kneeling.

Figure 12:
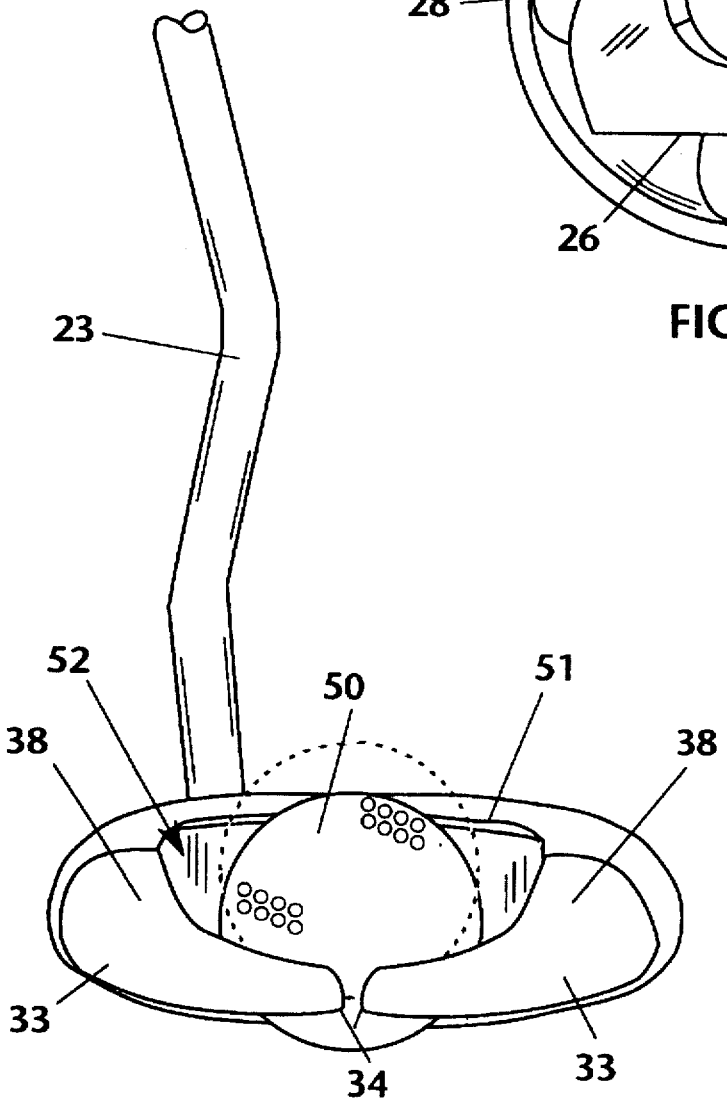
FIG. 12 is a rear elevation of the golf club head with a golf ball engaged in the ball pickup feature.

A further aspect of the invention comprises a ball release feature that functions in conjunction with the ball pickup feature. With regard to FIGS. 3, 4, and 12, a thin flange or lip 51 extends into the upper opening 52 of the concave recess 31. The lip 51 extends smoothly and continuously with the upper surface of the club head body, and includes a smoothly curved peripheral edge 53. The curvature of the edge 53 is conformal with the curvature of the sidewall 32 at their mutual intersections. The edge 53 defines with the interior surfaces 36 of the fingers an upper clearance that is slightly narrower than the diameter of a ball 50, and is also slightly narrower than the lower opening 41.

One function of the lip 51 is a positional stop for the ball pickup feature described above. When any golf ball 50 is urged into the lower end of the concave recess, the ball translates upwardly until it impinges on the curved edge 53 of the lip 51, as shown in FIG. 8. In this pickup position the ball 50 is gripped by the distal ends 34 of the resilient fingers against the curved surface 32, as described above, and the ball is lodged in the ball pickup structure. Also, a small portion of the ball 50 extends downwardly from the concave recess below the bottom surface of the club head body 24.

Figure 9:
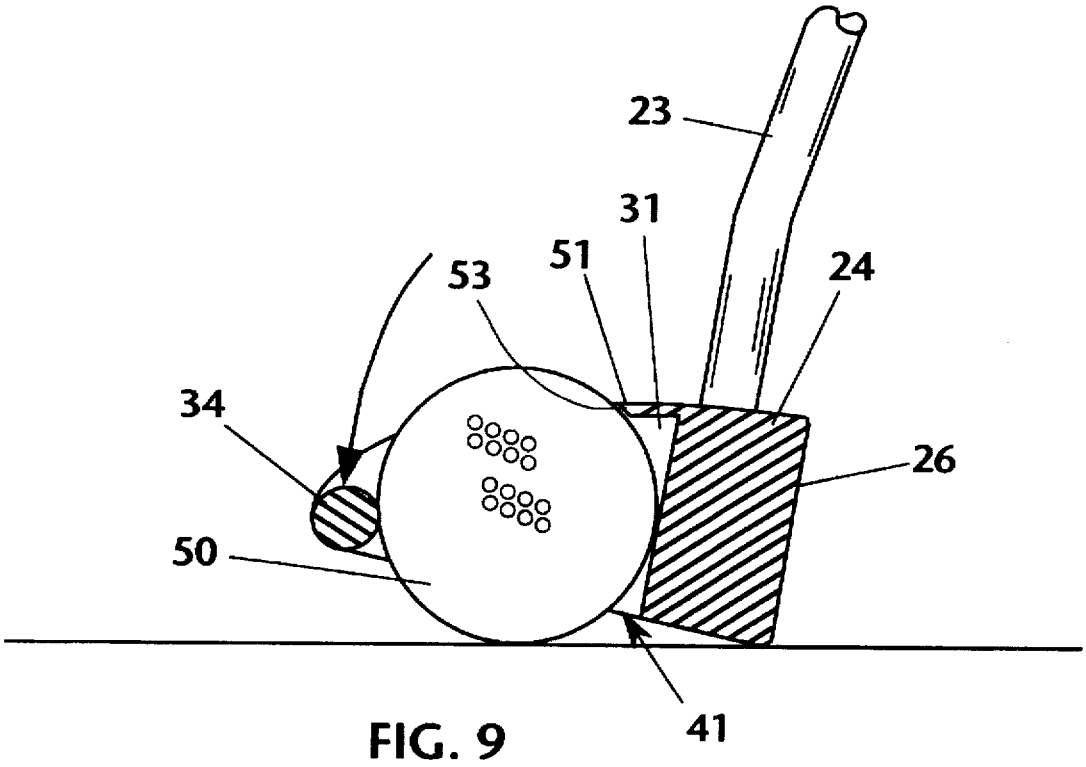
FIG. 9 is a cross-sectional side elevation of the golf club head as in FIG. 8, showing one method to urge the golf ball to the ball release position.
Figure 10:
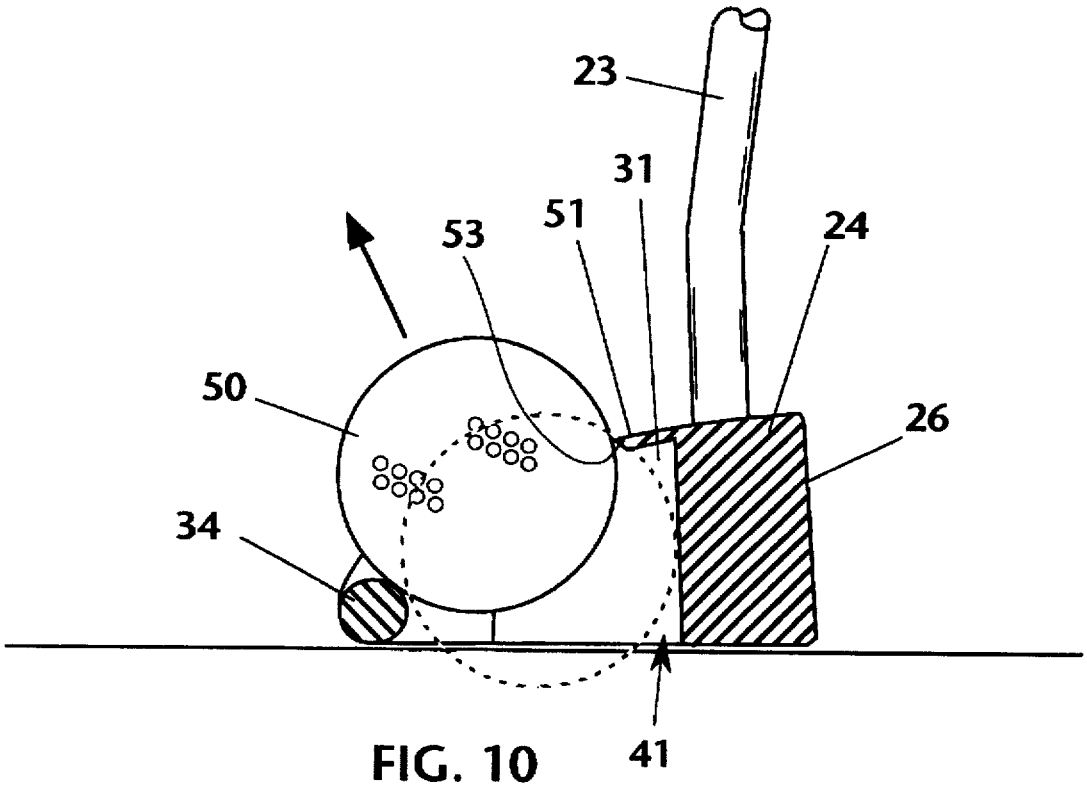
FIG. 10 is a cross-sectional side elevation of the golf club head as in FIG. 9, showing the golf ball supported in the ball release position.

The ball release feature involves moving the ball 50 lodged in the pickup position to a release position in which the ball is supported by, but not secured to the club head. With a ball lodged in the pickup position, as in FIGS. 9 and 12, the club may be wielded by the handle to urge the protruding portion of the ball against a ground or floor surface, forcing the ball upwardly to the position shown in FIG. 10. In another method, the lower front edge of the striking surface 26 is placed on the ground (FIG. 9), with the protruding ball impinging on the ground surface. By rocking the club head downwardly and rearwardly to increase the pressure on the protruding ball, the ball 50 is urged relatively upwardly in the concave recess to the release position, as shown in FIG. 10. In the release position a nominal equator of the ball is disposed above a plane extending from the lip edge 53 to the distal ends 34 of the fingers. The lip 51 and the distal ends of the fingers support the ball from below, and the upper opening 52 of the concave recess forms a receptacle in which the ball nestles to stabilize the ball. The ball 50 is not frictionally retained or otherwise gripped or detained, except by gravital effect, and may be removed by tilting the club head to cause the ball to roll out of the receptacle. Alternatively, the club head 22 may be flipped upwardly to toss the ball 50 out of the receptacle to be caught by the golfer.

Figure 11:
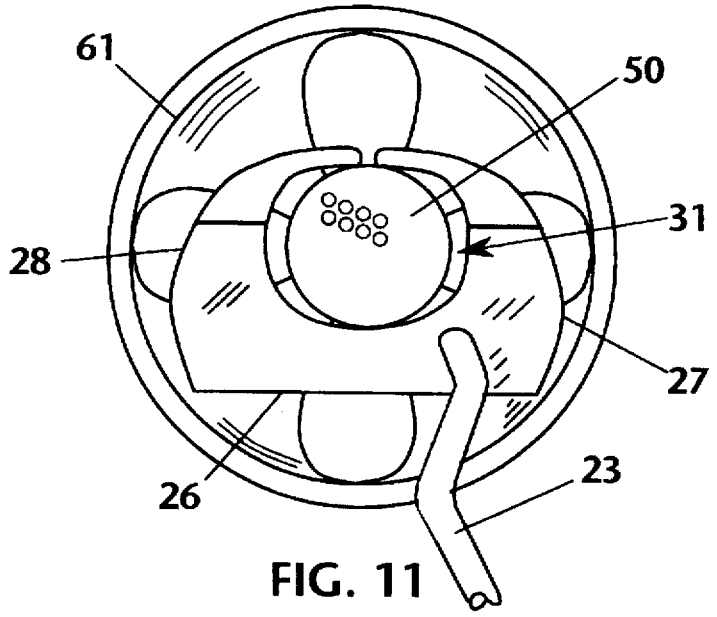
FIG. 11 is a top view of the golf club head of FIGS. 1–4 extended into a golf cup.

The conformation of the body 24, together with the ball pickup feature and the ball release feature, provides a further functional aspect to the invention. The spacing and curvature of the side surfaces 27 and 28, together with the curved outer surfaces 38 of the fingers 33, define a shape that is received within a golf hole cup 61, as shown in FIG. 11. The curved sides prevent damage to the cup, while permitting a full-width putting face 26. This dimensional relationship permits the use of the ball pickup feature within the cup 61, whereby a golf ball may be retrieved from the cup without bending or reaching by merely wielding and simply manipulating the golf club. The club head is placed in the cup with the lower opening over the ball, which gravitates to the center of the cup. The club is rocked rearwardly so that the fingers 33 engage the ball 50 and hold the ball in the pickup position, as described previously. The club is then rocked forwardly and lifted vertically to remove the club head and ball from the cup.

A further advantage of the invention resides in the vibration absorbing and acoustic dampening properties of the resilient fingers 33, which are formed of an elastic, deformable substance such as rubber, polymer plastic, or the like. The fingers receive vibration generated at the front striking surface and transmitted through the club head 24 to the rear surface 29 thereof. Vibrational energy is absorbed to a significant extent by the mass and shape of the fingers 33, reducing resonance and providing an improved feel for the stroke by the player. Moreover, the ball trajectory is improved by reducing vibration at the striking surface during the ball impact portion of the stroke.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. In a golf club that has a club head and a shaft extending to said club head, the improvement comprising:

ball pickup means, including a concave recess formed in a rear portion of said club head with said concave recess including a slotted aperture formed in said rear portion of said club head and opening rearwardly; and, detent means for engaging a golf ball and gripping the golf ball against a first portion of said concave recess, whereby the golf ball may be picked up from a ground surface;

said detent means securing a golf ball at a ball pickup position, and further including means for transferring a golf ball from said ball pickup position through said slotted aperture to a ball release position in which a golf ball is supported free of frictional engagement at an upper portion of said club head.

2. The golf club construction of claim 1, wherein said detent means includes resilient finger means extending substantially across said concave recess.

3. The golf club construction of claim 2, wherein said concave recess includes a lower opening disposed generally in a bottom surface of said club head.

4. The golf club construction of claim 3, wherein said resilient finger means defines a portion of said lower opening.

5. The golf club construction of claim 4, wherein said resilient finger means includes a pair of resilient fingers disposed in opposed, converging relationship.

6. The golf club construction of claim 5, wherein said concave recess includes a curved sidewall, and said pair of resilient fingers each include interior surface portions extending generally smoothly and continuously with adjacent portions of said curved sidewall.

7. The golf club construction of claim 1, wherein said concave recess includes a curved sidewall extending in generally cylindrical fashion.

8. The golf club construction of claim 7, wherein said curved sidewall includes an axis of symmetry extending generally upwardly.

9. The golf club construction of claim 7, wherein said curved sidewall has a radius of curvature that is substantially similar to the radius of the golf ball.

10. The golf club construction of claim 1, wherein said concave recess includes a slotted aperture formed in said rear portion of said club head and opening rearwardly,.

11. The golf club construction of claim 10, wherein said slotted aperture includes a lower end, and said detent means include resilient finger means extending substantially across said slot-like aperture at said lower end.

12. The golf club construction of claim 11, wherein said resilient finger means includes a pair of resilient fingers extending in opposed, converging relationship, said resilient fingers disposed to impinge a golf ball against an interior surface portion of said aperture and retain the ball in said aperture in a pickup position.

13. The golf club construction of claim 12, further including positional stop means for delimiting the upper extent of said pickup position.

14. The golf club construction of claim 1, wherein said means for transferring a golf ball includes a slotted aperture extending from said ball pickup position to said ball release position.

15. In a golf club that has a club head and a shaft extending to said club head, the improvement comprising:

ball pickup means, including a concave recess formed in a rear portion of said club head; and, detent means for engaging a golf ball and gripping the golf ball against a first portion of said concave recess, whereby the golf ball may be picked up from a ground surface;

said concave recess including a slotted aperture formed in said rear portion of said club head and opening rearwardly;

said slotted aperture including a lower end, and said detent means including resilient finger means extending substantially across said slotted aperture at said lower end;

said resilient finger means including a pair of resilient fingers extending in opposed, converging relationship, said resilient fingers disposed to impinge a golf ball against an interior surface portion of said aperture and retain the ball in said aperture in a pickup position;

further including positional stop means for delimiting the upper extent of said pickup position, said positional stop means including a curved lip extending into said slotted aperture at an upper end portion thereof, said lip disposed to impinge on an upper portion of a golf ball disposed in said pickup position.

16. The golf club construction of claim 15, wherein said upper end portion of said slotted aperture comprise a receptacle to receive a golf ball resting gravitally therein in a ball release position.

17. The golf club construction of claim 16, wherein a ball in said ball release position is supported by said lip and by upper surface portions of said resilient fingers.

18. The golf club construction of claim 17, further including a passageway through said slotted aperture to conduct a ball from said ball pickup position to said ball release position.

19. The golf club construction of claim 15, wherein said lip extends continuously and smoothly with an upper surface portion of said club head.

20. In a golf club that has a club head and a shaft extending to said club head, the improvement comprising:

ball pickup means, including a concave recess formed in a rear portion of said club head; and, detent means for engaging a golf ball and gripping the golf ball against a first portion of said concave recess, whereby the golf ball may be picked up from a ground surface;

said detent means including means for vibration absorption and acoustic dampening;

said means for vibration absorption and acoustic dampening including a substantial mass of deformable, resilient material secured to said club head;

said mass comprising a pair of resilient fingers operatively associated and positioned with respect to said concave recess to engage a golf ball.

* * * * *